US006593833B2

(12) United States Patent
Joines et al.

(10) Patent No.: US 6,593,833 B2
(45) Date of Patent: Jul. 15, 2003

(54) TUNABLE MICROWAVE COMPONENTS UTILIZING FERROELECTRIC AND FERROMAGNETIC COMPOSITE DIELECTRICS AND METHODS FOR MAKING SAME

(75) Inventors: William T. Joines, Durham, NC (US); William D. Palmer, Durham, NC (US)

(73) Assignee: MCNC, Research Triangle Park, NC (US)

( * ) Notice: Subject to any disclaimer, the term of this patent is extended or adjusted under 35 U.S.C. 154(b) by 0 days.

(21) Appl. No.: 09/826,548

(22) Filed: Apr. 4, 2001

(65) Prior Publication Data

US 2002/0171516 A1 Nov. 21, 2002

(51) Int. Cl.[7] ..... H01P 3/08
(52) U.S. Cl. ..... 333/238; 333/99.005
(58) Field of Search ..... 333/995, 238; 505/210, 238, 239, 700

(56) References Cited

U.S. PATENT DOCUMENTS 4,141,080 A 2/1979 Paul et al.
4,244,722 A 1/1981 Tsuya et al.
4,480,254 A 10/1984 Spencer et al.
4,554,519 A 11/1985 Adam
4,853,660 A 8/1989 Schloemann
4,918,050 A * 4/1990 Dworsky ..... 333/995
5,162,977 A 11/1992 Paurus et al.
5,312,790 A 5/1994 Sengupta et al.
5,568,106 A 10/1996 Fang et al.
5,587,943 A 12/1996 Torok et al.
5,589,845 A 12/1996 Yandrofski et al.
5,607,631 A 3/1997 Wolfson et al.
5,640,042 A 6/1997 Koscica et al.
5,721,194 A 2/1998 Yandrofski et al.
5,830,591 A 11/1998 Sengupta et al.
5,870,274 A 2/1999 Lucas
5,912,472 A 6/1999 Voigtlaender et al.
5,912,486 A 6/1999 Summerfelt
5,925,455 A 7/1999 Bruzzone et al.
5,926,073 A 7/1999 Hasegawa et al.
5,930,165 A 7/1999 Johnson et al.
6,097,271 A * 8/2000 Kozakoff ..... 333/238

* cited by examiner

*Primary Examiner*—Benny Lee
(74) *Attorney, Agent, or Firm*—Alston & Bird LLP

(57) ABSTRACT

A passive microwave component with constant impedance and electrically adjustable phase length utilizes a microstrip or stripline transmission line geometry incorporating a composite dielectric having both ferroelectric (FE) and ferromagnetic (FM) properties. These properties can be varied with externally applied electric and magnetic fields such that the phase length (or electrical length) of the line can be varied without varying the characteristic impedance of the transmission line. Thus, the component can be electrically tuned without adversely affecting the impedance match. The component can be used in microwave devices such as phase shifters, frequency filters, directional couplers, power dividers and combiners, and impedance-matching networks.

16 Claims, 5 Drawing Sheets

TUNABLE MICROWAVE COMPONENTS UTILIZING FERROELECTRIC AND FERROMAGNETIC COMPOSITE DIELECTRICS AND METHODS FOR MAKING SAME

FIELD OF THE INVENTION

The present invention relates generally to microwave components, and more specifically, to tunable microwave components constructed using composite dielectrics.

BACKGROUND OF THE INVENTION

Conventional microwave components are typically designed by establishing specific values of the characteristic impedance and the electrical length of transmission line segments within a particular component. Maintaining specific characteristic impedances and electrical lengths is desirable so that a circuit or system can operate within particular design parameters. As a result, circuits are typically designed relative to these values such that a circuit or system can achieve desired performance. To establish specific values of characteristic impedance and electrical length, typical tunable microwave components are often constructed utilizing materials having fixed electric permittivity and magnetic permeability, as permittivity and permeability contribute to the calculation of such values.

As will be appreciated by those of skill in the art, tunable microwave devices have also been fabricated using either tunable magnetic or ferroelectric components. However, using only magnetic or electrical tuning components can result in an impedance mismatch because the characteristic impedance of a transmission line is directly proportional to the square root of the ratio of magnetic permeability to electric permittivity. The mismatch will become apparent when a device that incorporates only magnetic or electrical tuning components, such as a tunable microwave filter, is attempted to be tuned. This impedance mismatch can cause transmission problems and reduced component performance, and reduced performance of the system in which the device is included. Furthermore, the use of other tunable materials, such as ferrite rods, FETs, PIN diodes and varactor diodes (also called veracitors) in constructing frequency agile systems has often lead to undesirable high microwave losses. Many of these devices, while performing their tuning function, highly attenuate the microwave signals or cause excessive radiation of the microwave signals. Additionally, many of the currently used tunable devices cause intermodulation distortion (IMD) when information is modulated onto the microwave carrier signal.

Low-loss, high speed, tunable microwave components are useful in a variety of electrical systems, and may be necessary for the construction of certain systems, such as next generation communication systems. For example, next generation systems require that microwave losses be minimized to achieve suitable signal to noise ratios, and that microwave devices enable switching speeds that are increased over current speeds by one or two orders of magnitude. This is clearly evident in applications involving barium strontium titanate (BST) thin films, which are deposited by pulsed laser deposition (PLD) onto dielectric substrates and are currently being used to develop frequency agile microwave electronics. Nevertheless, the characteristic impedance of these devices suffers a large change when the dielectric constant is reduced by a large factor, such as a factor of four or more. This reduction in the dielectric constant could occur, for example, during the process of tuning the filter.

Therefore, in order to construct next generation systems, high performance, efficient, frequency agile microwave components are needed that have relatively low microwave losses, constant impedance, and high switching speeds, for use in higher speed electronic systems.

SUMMARY OF THE INVENTION

The present invention discloses tunable microwave components including a strip line or microstrip transmission line having a composite dielectric constructed with both ferroelectric (FE) and ferromagnetic (FM) materials. The FE and FM properties of these respective materials can be varied with externally applied electric and magnetic fields such that the electrical length (or phase length) of the transmission line can be varied without varying the characteristic impedance of the transmission line. Thus, the component can be electrically tuned to operate at different frequencies without adversely affecting the impedance matching of the circuitry. As a result, a microwave component according to the present invention can be used in a variety of microwave devices, such as phase shifters, frequency filters, directional couplers, power dividers and combiners, impedance matching networks, and the like.

According to one embodiment of the present invention, there is disclosed a tunable low-loss microwave component, in communication with a power source producing an applied voltage and an applied current. The tunable component includes at least one ferroelectric (FE) material, wherein the at least one FE material changes electric permittivity with the applied voltage, and at least one ferromagnetic (FM) material, wherein the at least one FM material changes magnetic permeability with the applied current, such that the tunable microwave component is tunable to at least a first frequency when the component is a non-bias state, and tunable to at least a second frequency when the component is in a bias state, and wherein the tunable microwave component has a constant characteristic impedance at the first and second frequencies.

According to one aspect of the present invention, the tunable microwave component has a constant electrical length at the first and second frequencies. According to another aspect of the present invention, the at least one FE material and the at least one FM material can be mixed to create a FE/FM composition having both FE and FM material properties. Furthermore, the FE material can include barium strontium titanate. Additionally, according to the invention, the tunable component can include a first conductor in communication with the power source, wherein voltage and current applied via the first conductor can cause the tunable microwave component to enter the bias state. Moreover, the tunable microwave component can be a microwave transmission line.

According to one embodiment of the present invention, there is disclosed a microwave transmission line. The microwave transmission line includes a first conductor, a second conductor, and a central conductor disposed between the first conductor and the second conductor. The microwave transmission line also includes a composite, comprising at least one ferroelectric material and at least one ferromagnetic material, wherein the composite substantially surrounds the center conductor, such that the transmission line is tunable to at least a first frequency when the composite is a non-bias state, and tunable to at least a second frequency when the composite is in a bias state, and wherein the microwave transmission line has a constant characteristic impedance at the first and second frequencies.

According to one aspect of the present invention, the composite can include a mixture of the at least one ferroelectric material and the at least one ferromagnetic material. According to another aspect of the invention, the composite can include one block of the at least one ferroelectric material and one block of the at least one ferromagnetic material, and wherein the block of the at least one ferroelectric material is located adjacent the center conductor and adjacent to the first conductor, and wherein the block of the at least one ferromagnetic material is located adjacent the center conductor and adjacent to the second conductor. According to yet another aspect of the invention, the composite can include alternating layers of the at least one ferroelectric material and the at least one ferromagnetic material.

According to another embodiment of the invention, there is disclosed a method of creating a tunable, low-loss transmission line having outer conductors and a central conductor. The method includes providing at least one ferromagnetic (FM) material, providing at least one ferroelectric (FE) material, combining the at least one FM material and the at least one FE material to produce a FM/FE composition, surrounding the center conductor with the FM/FE composition, and sandwiching the FM/FE composite and center conductor in between the outer conductors.

According to one aspect of the present invention, combining the at least one FM material and the at least one FE material includes mixing the at least one FM material and the at least one FE material to produce a mixed FM/FE composition. Furthermore, combining the at least one FM material and the at least one FE material can include alternating layers of the at least one FE material and the at least one FM material to produce a layered FM/FE composite. According to yet another aspect of the present invention, combining the at least one FM material and the at least one FE material includes locating a block of the at least one FE material adjacent the center conductor and adjacent one of the outer conductors, and locating a block of the at least one FM material adjacent the center conductor and adjacent one of the other outer conductors.

According to yet another embodiment of the invention, there is disclosed a method of constructing a microstrip circuit. The method includes providing a thick film FM/FE composite, including at least one FM material and at least one FE material, disposing microstrip transmission lines on the thick film FM/FE composite, locating the thick film FM/FE composite directly adjacent a microwave substrate, and providing a ground plane located adjacent the microwave substrate on a side of the microwave substrate located opposite the thick film FM/FE composite.

DETAILED DESCRIPTION OF THE INVENTION

Figure 1:
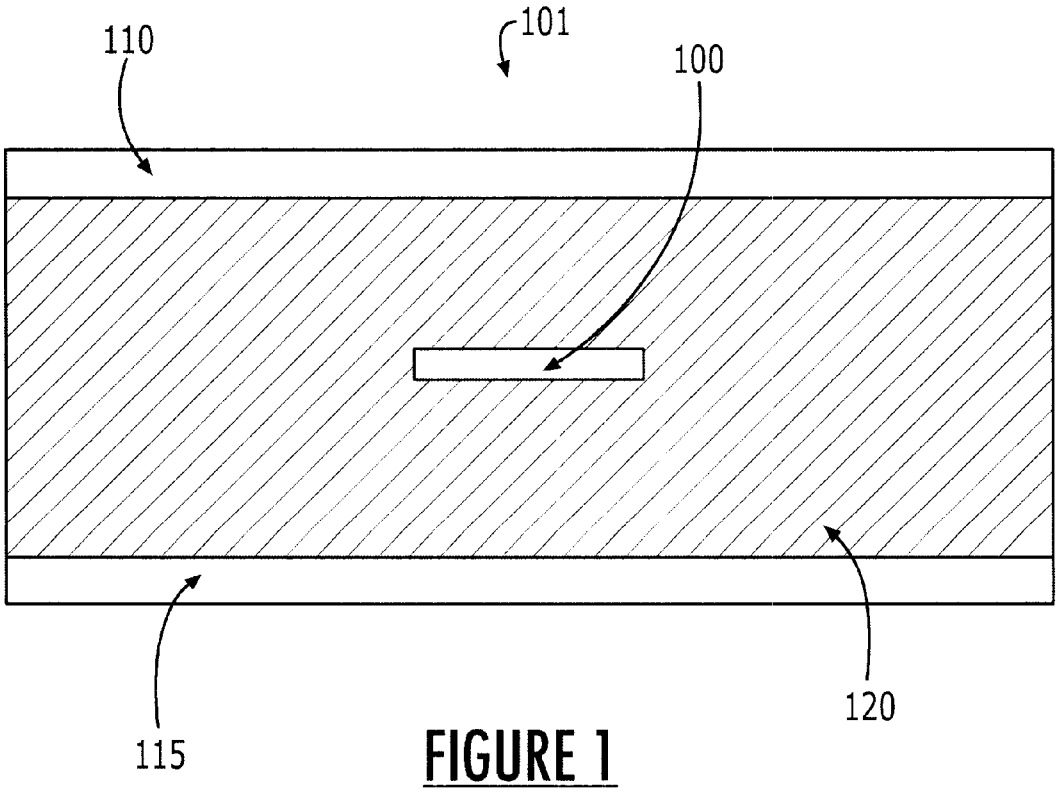
FIG. 1 shows a stripline transmission line including a composite dielectric, according to one aspect of the present invention.

The present invention will now be described more fully hereinafter with reference to the accompanying drawings, in which preferred embodiments of the invention are shown. This invention may, however, be embodied in many different forms and should not be construed as limited to the embodiment set forth herein; rather, these embodiments are provided so that this disclosure will be thorough and complete, and will fully convey the scope of the invention to those skilled in the art. Like numbers refer to like elements throughout.

As will be appreciated by one of ordinary skill in the art, the electrical length of a transmission line is equal to $2\pi fl\sqrt{\mu\in}$, where f is the operating frequency, l is the physical length of the transmission line, and $\sqrt{\mu\in}$ represents a function of velocity through a medium having an electric permittivity ($\in$) and a magnetic permeability ($\mu$). As is also well known to those of ordinary skill in the art, the characteristic impedance of a transmission line equals $F(g)\sqrt{\mu/\in}$, where F(g) represents a constant dependant on the conductor cross-sectional geometry (width and spacing) for a given line or segment. In conventional microwave devices, the physical properties of the conductor are normally adjusted to achieve a desired characteristic impedance $Z_o$. Based on these equations, it will be appreciated that if the magnetic permeability ($\mu$) and dielectric permittivity ($\in$) can be controllably varied to keep their ratio constant, the characteristic impedance of a device may be kept constant as the device is tuned to different frequencies. Furthermore, where high-permittivity dielectric materials are used, the physical length of phase delay lines or tunable components can be reduced by a factor of $1/\sqrt{\in}$, thus reducing the overall size of the device.

To controllably tune the magnetic permeability and dielectric permittivity of tunable microwave devices, such as transmission lines, the present invention utilizes both FE and FM materials in the construction of the devices. More specifically, microwave devices according to the present invention exploit the FE and FM material properties to controllably vary the magnetic permeability ($\mu$) and dielectric permittivity ($\in$) to maintain a constant characteristic impedance regardless of the frequency at which the device is tuned. Because FE and FM materials possess the advantage of high switching speeds, devices according to the present invention provide the potential for higher speed electronic systems.

As will be appreciated by those of skill in the art, FE and FM materials both react in response to an applied field. Therefore, the materials have a bias state, which is the state of the material in the presence of a field, and a nonbiased state, which is the natural state of the material absent an applied field. FE materials have the property that the electric permittivity of the material changes with an applied electric field (E), whereas FM materials have the property that the magnetic permeability of the material changes with an applied magnetic field (H).

Because the characteristic impedance of a transmission line is proportional to $\sqrt{\mu/\in}$, the lines' characteristic impedance will remain constant where the relationship $\mu/\in$ is held constant. Therefore, varying either the magnetic permeability ($\mu$) or the dielectric permittivity ($\in$) without a corresponding change in the other component will result in an altered characteristic impedance, which may be undesirable to the proper functioning of a component or system. Therefore, according to one aspect of the present invention, a composite FE-FM dielectric is constructed that allows both the permittivity and permeability to simultaneously vary in relation to each other so that a device's characteristic impedance remains constant at different operating frequencies. According to the present invention, the electrical permittivity and magnetic permeability of the FE/FM composite dielectric are adjustable to desired values by adjusting an applied direct voltage and direct current supplied to the composite within the microwave device. For instance, in a transmission line, a direct voltage between a center conductor of width w and the outer conductor, changes $\in_1$ to $\in_2$ in the FE material, and a direct current along the width w changes $\mu_1$ to $\mu_2$ in the FM material. As such, it will be appreciated that at least one power source is required to provide the voltage and current for adjusting the properties of the FE/FM composite. It will be appreciated that the creation of a low-loss device according to the present invention can be useful in the construction of microwave components and devices, such as phase shifters, frequency filters, directional couplers, power divider/combiners, impedance-matching networks and, the like.

FIG. 1 shows a stripline transmission line 101 constructed using a FE/FM composite dielectric 120 having both FE and FM materials therein, according to one aspect of the present invention. The stripline transmission line 101 includes an outer conductor 110, a center conductor 100, a composite dielectric 120, and a ground 115. A direct voltage supplied by a power source (not illustrated) and applied between the center conductor 100 and the outer conductor 110 will produce an electric field that changes the permittivity of the FE material. On the other hand, a direct current along the center conductor 100 will produce a magnetic field that changes the permeability of the FM material. According to one aspect of the invention, a bias supply may be used, wherein the bias supply separately controls the voltage from the center conductor 100 to ground 115, as well as the current that flows along the outer conductor 110. Therefore, applied voltage and current will effectively alter the respective permeability and permittivity of the transmission line 101. Stronger magnetic biasing can also be produced by incorporating a solenoidal winding surrounding the transmission line 101. As will be appreciated by those of ordinary skill in the art, still other electric and magnetic field application techniques could be implemented. As illustrated in FIG. 1, the composite dielectric material 120 includes a combination of FE and FM materials mixed on a granular scale to produce a homogenous composition. However, it should be appreciated that the FE and FM materials must be mixed together to produce a homogenous composition that does not adversely affect the electromagnetic properties of the material. Suitable FE and FM materials will be discussed in detail below.

Figure 2:
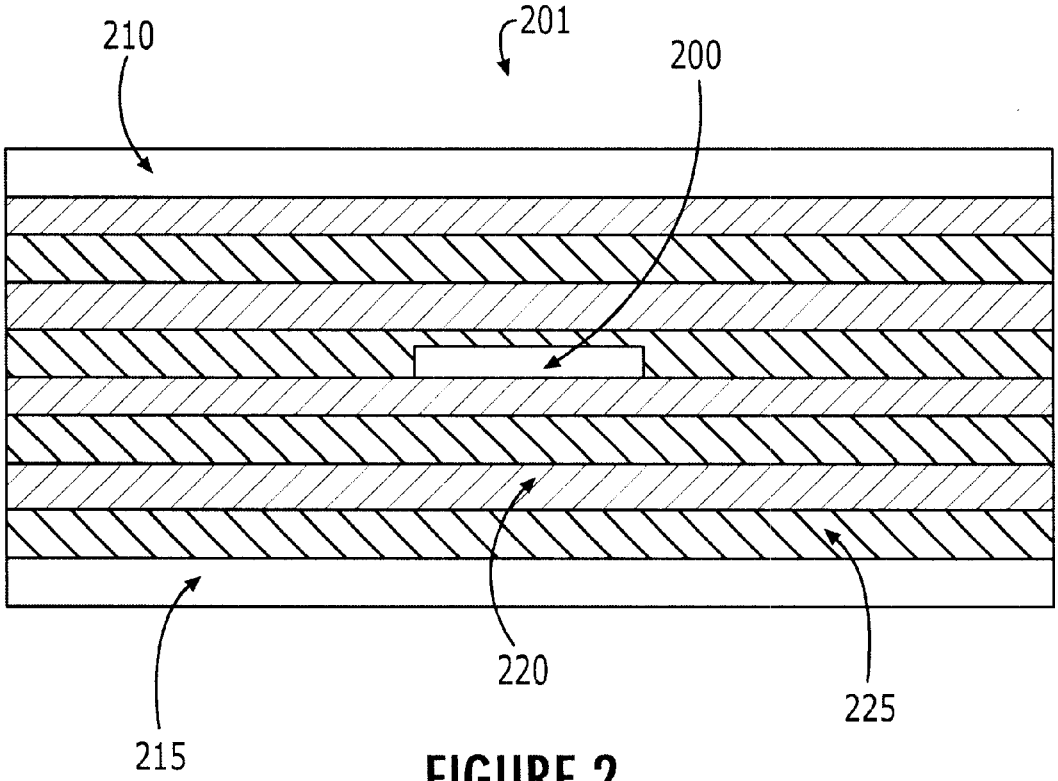
FIG. 2 shows a stripline transmission line including a composite dielectric composed of alternating thin layers of FE and FM materials, according to one aspect of the present invention.

FIG. 2 shows a stripline transmission line 201 having thin layers of alternating FE material 220 and FM material 225, according to another aspect of the present invention. As shown in FIG. 2, the layers of FE and FM material are built up to surround a center conductor 200 located between a conductor 210 and ground 215 of the transmission line 201. According to yet another aspect of the invention illustrated in FIG. 3, a microstrip transmission line 301 according to the present invention can be constructed using two slabs of dielectric material, one slab of FE material 320 and the other with FM material 325, surrounding a center conductor 300, and located between an outside conductor 310 and ground 315. As with the embodiment illustrated in FIG. 1, a direct voltage applied between the center conductor 200, 300 and the outer conductors 210, 310 and ground 215, 315 of the striplines of FIG. 2 or FIG. 3, respectively will produce an electric field that changes the permittivity of the FE material 220, 320, while a direct current along the center conductor 200, 300 will produce a magnetic field that changes the permeability of the FM material 225, 325.

Figure 3:
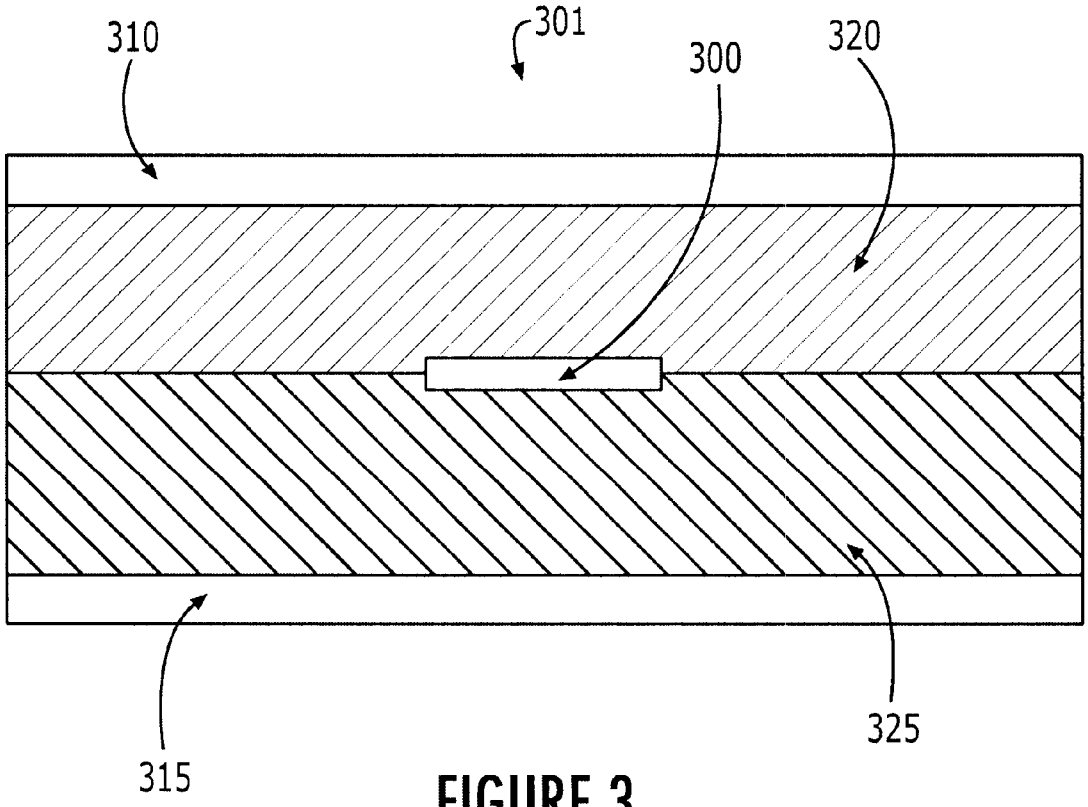
FIG. 3 shows a stripline transmission line including two adjacent blocks of FE and FM materials, according to one aspect of the present invention.

In constructing the FE/FM composite devices of the present invention, including those illustrated in FIGS. 1–3, FM materials such as Mn—Zn ferrites, $(Mn,Zn)Fe_2O_4$, are preferably used due to their low coercivity and high magnetization, which makes them desirable for tunable components with minimum or low switching magnetic fields. Other lower loss compositions, such as Ni—Zn ferrites, may also be used despite lower magnetization to reduce losses at microwave frequencies. According to one aspect of the present invention, FE materials utilized in the FE/FM compositions can include barium strontium titanate (BST), or other low-loss FE materials, as are well known in the art. According to another aspect of the invention, FE materials within the FE/FM composition can include $SrTiO_3$ (ST), or $(NH_4)_4Tl_3(H_2AsO_4)_7$, typically called Atlas. It will be appreciated by those of ordinary skill in the art that other suitable FM and FE materials can be utilized for inclusion into a tunable microwave component according to the present invention. These materials may have a variable range of density, porosity, or grain size. Furthermore, these materials may be substituted for, or used in combination with, those materials discussed above.

Although the individual values of $\mu$ and $\in$ for FE and FM materials may be calculated using well known methods, a measurement and a dimension-based calculation of $Z_O$ can also be used to determine the ratio $\mu$ and $\in$. For instance, using a uniform stripline with center-conductor gaps (or capacitances) spaced a distance d apart will cause a dip in the swept-frequency measurement of transmission loss when d is an integer multiple of a half wavelength. From this information the electrical length of the line, and thus the product $\mu\in$, can be determined. Hence, the effective values of $\mu$ and $\in$ can be resolved from the equation for the electrical length of the line, and the design of a switchable, or active, transmission line can be completed by adjusting the cross sectional geometry (represented by F(g)) to achieve the desired value of $Z_O$.

To produce microwave components of the present invention, the FE/FM composite materials are chosen and mixed such that a change in permittivity will also be accompanied by a change in permeability so that a constant ratio is maintained between the permittivity and permeability. According to one aspect of the invention, the fabrication of the FE/FM composite dielectric can be accomplished by fabricating bulk ceramic composite materials processed by tape casting. To produce the bulk composite materials, ceramic slurries containing mixed phase FM/FE compositions (see. e.g., FIG. 1) can be cast in sheets and sintered, or alternating layers of FM and FE composition (see, e.g., FIG. 2) can be cast and co-fired. For large scale production of integrated microwave devices according to the present invention, thick film printing using ceramic or similar slurries with added bonding agents, as are well known in the art, can be used.

It should be appreciated that bulk ceramic composites for use in components according to the present invention must have suitable magnetic and dielectric tunability at microwave frequencies. Therefore, proper optimization of material characteristics and magnetic and electrical tunability is desirable prior to the design and fabrication of filter devices. Where composites with different compositional variations are used, unloaded Q factors can be calculated to determine the bandwidth and loss of the designed structure, thereby providing a figure of merit for the particular compositional variation. Furthermore, it will be appreciated that FE and FM materials used in microwave device according to the present invention are limited only that they have low loss at microwave frequencies, and that they have operate in an area where the electric flux density (D)—electric field intensity (E) curve for the FE material and the magnetic flux density (B)—magnetic field intensity (H) curve for the FM material are linear. As will be appreciated by those of skill in the art, because the present invention utilizes a combination of FE and FM materials, which must be varied in specific relation to each other, each material should be within its linear range of operation.

After the creation and optional testing of the FE/FM composite to ensure the composite is suitable for tunability, tunable filter devices such as stripline conductors or microstrip circuits on ceramic substrates can be designed and fabricated. According to one aspect of the invention, stripline conductors can be fabricated as illustrated in FIGS. 1–3. However, microstrip circuits according to the invention can also be patterned on thick film FM/FE composites deposited on microwave substrates, such as alumina or barium titanate. One such microstrip circuit 401 is illustrated in FIG. 4.

Figure 4:
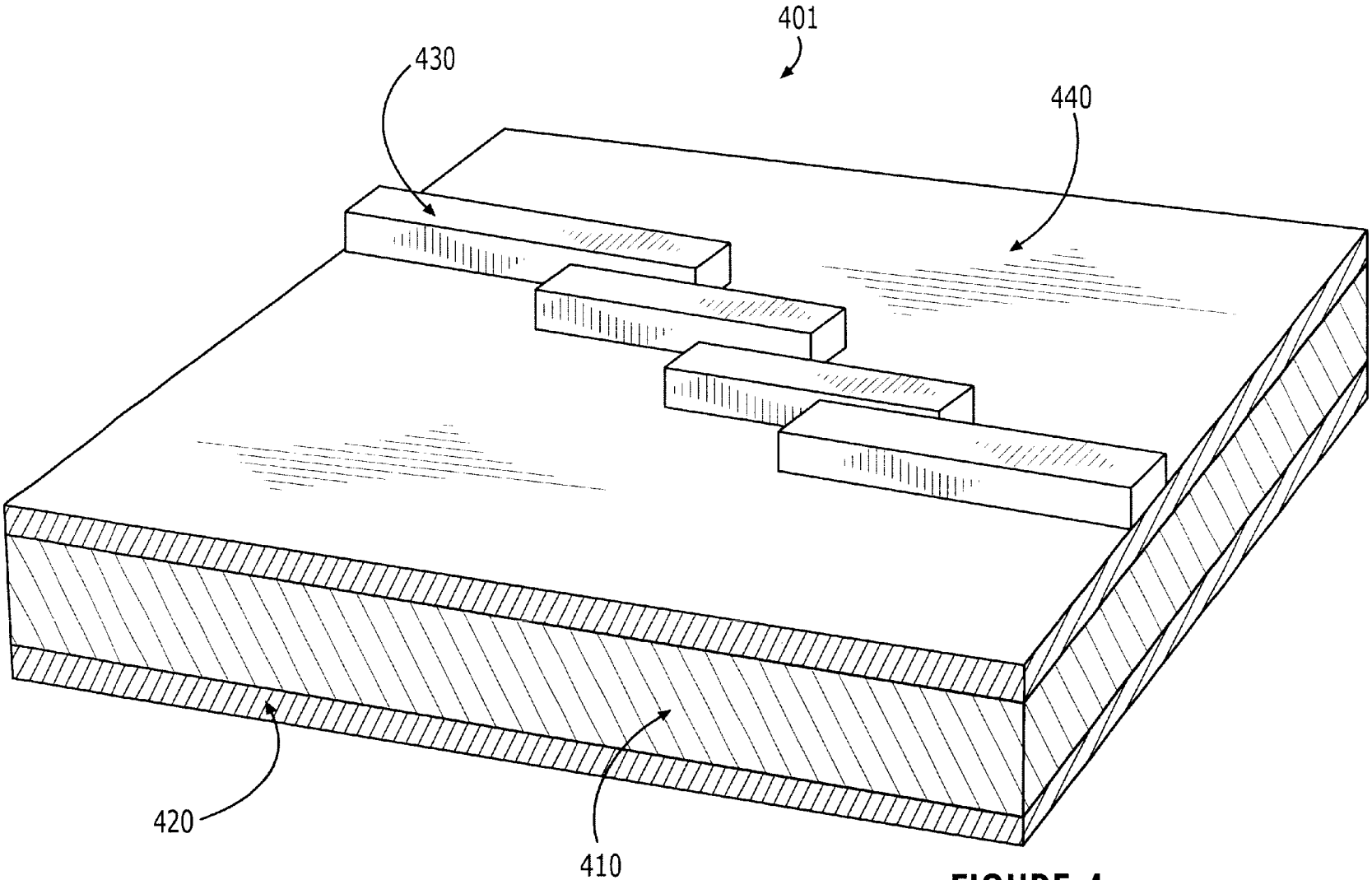
FIG. 4 shows a microstrip circuit including a thick film FM/FE composite, according to one aspect of the present invention.

FIG. 4 shows a microstrip circuit 401 including a thick film FM/FE composite 440, upon which microstrip transmission lines 430 are disposed. The thick film FM/FE composite 440 is located directly adjacent the microwave substrate 410, which is disposed, in turn, on a ground plane 420. It will be appreciated that other configurations of the microstrip circuit 401 are also possible. For instance, the ground plane 420 may be sandwiched directly between the substrate 410 and the FE/FM composite. When a voltage and magnetic field are applied to the FE/FM composite, the permittivity and permeability of the composite 440 can be controllably varied such that the characteristic impedance of the microstrip circuit can remain constant despite tuning the circuit 401 to different frequencies.

Figure 5:
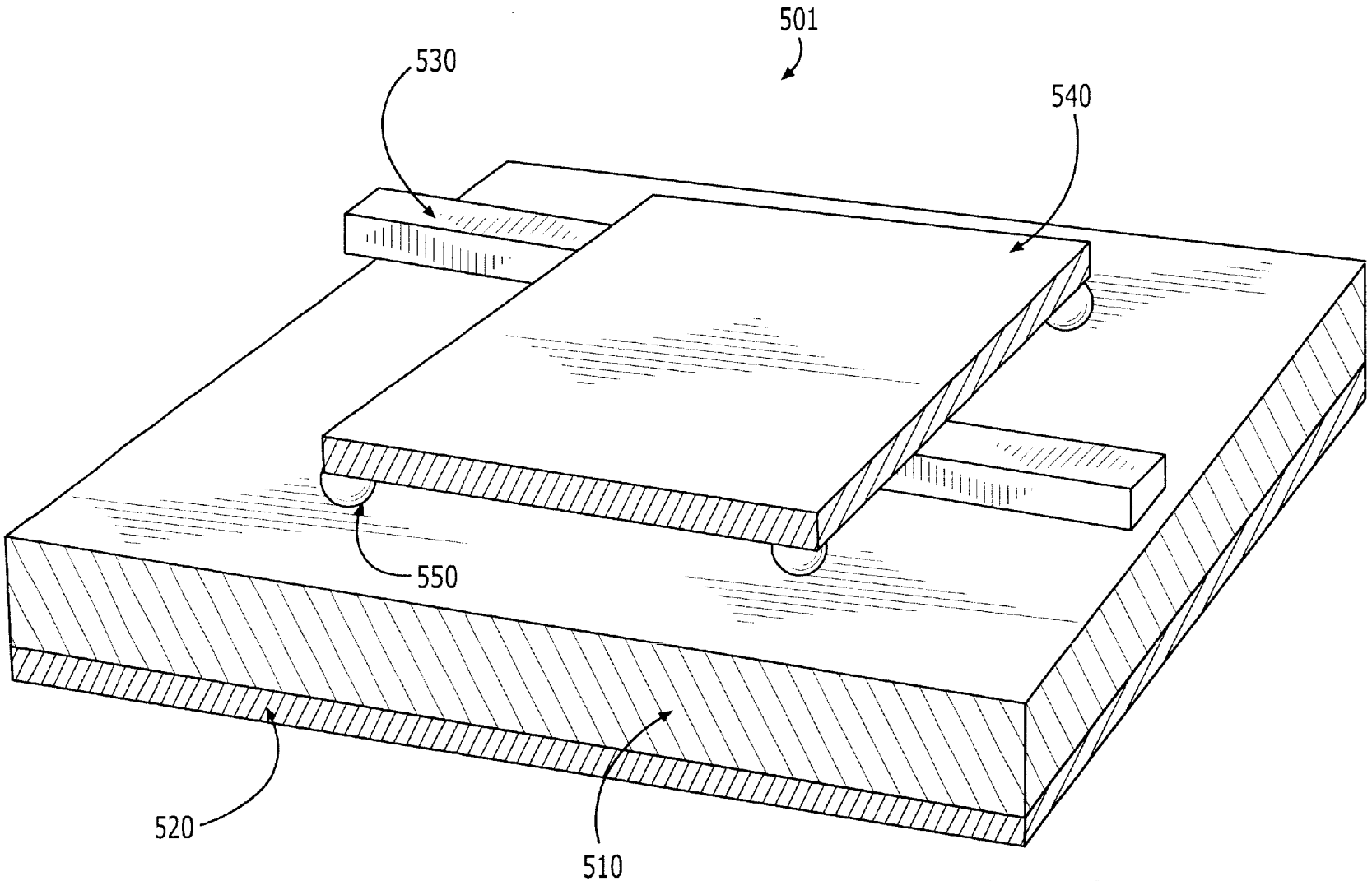
FIG. 5 shows a microstrip device including a flip-chip FM/FE composite substrate, according to one aspect of the present invention.

FIG. 5 shows a microstrip device including a flip-chip FM/FE composite substrate, according to one aspect of the present invention. As illustrated in FIG. 5, a flip-chip FE/FM composite substrate 540 can be constructed and attached by solder bumps 550 or the like to a substrate 510 carrying microstrips 530 to create a tunable lumped-element configuration. Ground plane 520 can also be located on a side of the substrate opposite the microstrips 530, and can also be located directly adjacent the FE/FM composite substrate, on an opposite side of the substrate from the transmission lines 530. It will be appreciated that additional devices can be configured, and that the microstrip device 501 can include additional optional elements. For instance, active circuitry could also be included on the FE/FM composite substrate 540 and attached to the substrate 510 and/or transmission lines 530 in a flip-chip configuration to construct compact, high-performance microwave devices.

The present invention will be more easily understood with respect to the following discussion, which illustrates how the characteristic impedance $Z_o$ may be held constant using a FE/FM composite according to the present invention. As previously indicated, microwave components and devices are designed by determining specific values of the characteristic impedance $Z_o$ and the electrical phase length $\Theta$ of each segment of transmission lines comprising a particular component or device. If l is the physical length of the line segment, the electrical length is:

$$\Theta=2\pi fl/v=2\pi fl\sqrt{\mu\in}$$

where f is the design frequency and $v=1/\sqrt{\mu\in}$ is the velocity of propagation through the medium. For a given line or line segment, a cross-sectional geometry (conductor with end spacing) is normally adjusted to achieve a desired $Z_o$. If the cross-sectional function of geometry is designated as F(g), then the characteristic impedance is $$Z_0=\sqrt{\frac{\mu}{\varepsilon}}F(g)$$

Therefore, where $\sqrt{\mu/\in}$ is held constant, $Z_0$ does not change.

Utilizing the FE and FM composite according to the present invention, the relationship between the magnetic permeability ($\mu$) and the dielectric permittivity ($\in$) are held constant such that switching between two bias states on the FE-FM composite dielectric allows a filter to be constructed that can operate equally well at two different frequencies, such as at both X-band and Ku-band. For instance, if a microwave component such as a frequency filter is to operate at 10 gigahertz in the X-band and at 15 gigahertz in the Ku band, the electrical length of the component must be held constant at both frequencies of interest. Using the above equation for electrical length, $$\Theta_{10\ GHz}=2\pi 10\times 10^9 l\sqrt{\mu_{10}\in_{10}}$$

and $$\Theta_{15\ GHz}=2\pi 15\times 10^9 l\sqrt{\mu_{15}\in_{15}}$$

Setting these electrical lengths equal gives $$2\pi 10\times 10^9 l\sqrt{\mu_{10}\in_{10}}=2\pi 15\times 10^9 l\sqrt{\mu_{15}\in_{15}},$$

Cancelling common terms, squaring both sides of the equation, and rearranging gives:

$$\mu_{10}\in_{10}=(15/10)^2\mu_{15}\in_{15}=2.25\mu_{15}\in_{15}$$

To keep the characteristic impedance constant at both operating frequencies, the relationship $$\frac{\mu_{10}}{\varepsilon_{10}}=\frac{\mu_{15}}{\varepsilon_{15}}$$

must be satisfied. Thus, in this example, one could choose $$\mu_{10}=\sqrt{2.25}\mu_{15}=1.5\mu_{15}$$

and $$\in_{10}=\sqrt{2.25}\in_{15}=1.5\in_{15}$$

such that both the requirement for contant electrical length and characteristic impedance are satisfied at both operating frequencies. Therefore, the FE/FM composite can be created such that the values of $\mu_{10}$ and $\in_{10}$ change in the presence of an applied voltage and current to $\mu_{10}/1.5$ and $\in_{10}/1.5$ such that both the electrical length characteristic impedance will remain constant at 10 gigahertz and 15 gigahertz, respectively.

Therefore, according to one aspect of the present invention, it will be appreciated that changing the operating frequency of a device from $f_1$ to $f_2$, both the characteristic impedance and electrical length will remain the same if $\mu_1$ and $\in_1$ are changed to $\mu_2$ and $\in_2$ and $\mu$ and $\in$ have the relationship described above. Therefore, all microwave components with performance based upon the characteristic impedance and electrical length of conductors, such as filters and couplers, can have the same response characteristics over a frequency band centered at $f_1$ as at $f_2$. On the other hand, a smaller change in $\mu$ and $\in$, depending upon an applied bias, would yield a smaller phase shift per unit length, and a smaller change in frequency would be required to counteract the phase shift. Therefore, where desired, composites according to the present invention can maintain the electrical length of a device at multiple frequencies in addition to maintaining a constant characteristic impedance.

Figure 6:
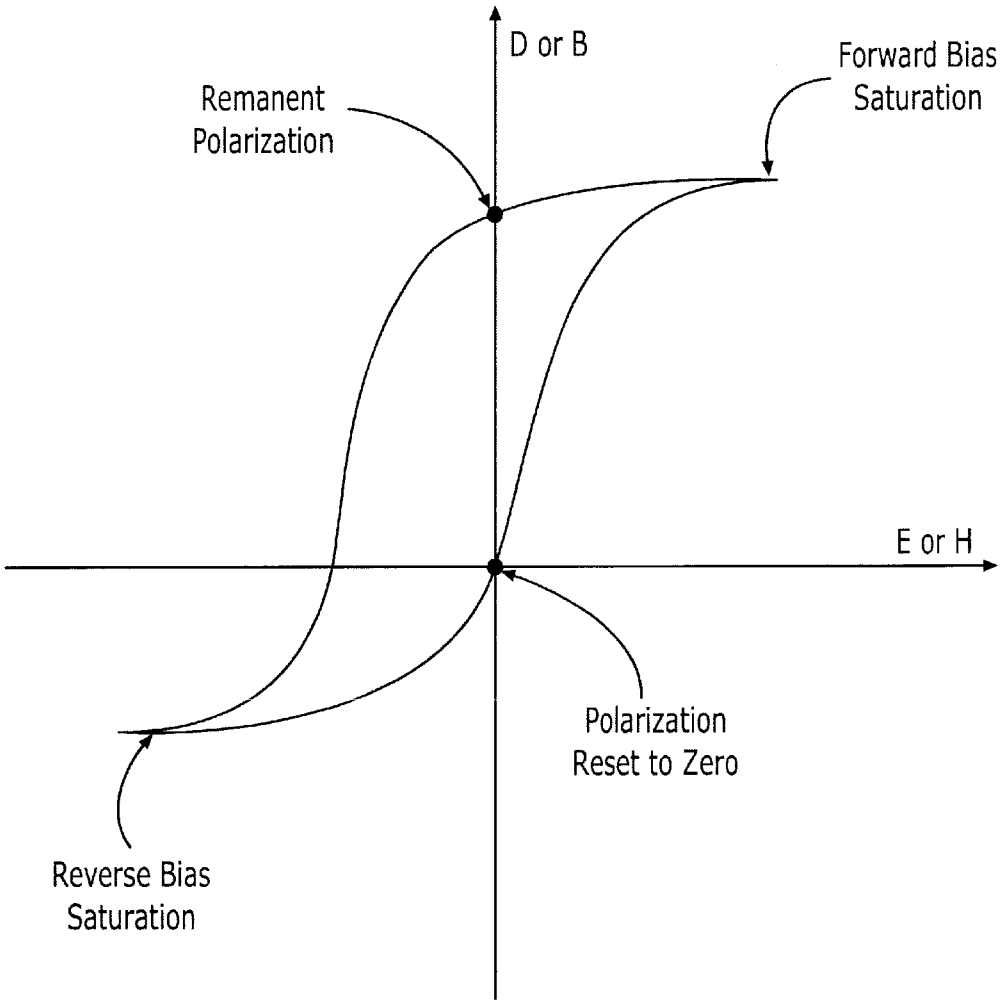
FIG. 6 shows a hysteresis curve typical of both ferroelectric and ferromagnetic materials, according to one aspect of the present invention.

It should also be appreciated that tunable band pass filters, bias controlled phase shifters and latching phase shifters for producing nonvolatile memory can also be constructed according to the present invention by taking advantage of the remanent polarization and resetability properties seen in both ferroelectric and ferromagnetic materials. FIG. 6 shows a hysteresis curve relating applied field to flux density. For ferroelectric materials, this is known as a D-E curve, where D is the electric flux density in coulombs per square meter and E is the applied electric field in volts per meter. For ferromagnetic materials, this is known as a B-H curve, where B is the magnetic flux density in webers per square meter and H is the applied magnetic field in amperes per meter. When the material starts out with zero field bias, there is zero polarization. After the bias field is increased in the forward direction to saturation and then decreased back to zero, some polarization will remain in the material without an external applied field. This remanent polarization is reset to zero by applying a field in the reverse direction at the appropriate strength such that the polarization traverses the hysteresis curve to reverse saturation and returns to zero when the external field is removed.

An additional application that could also utilize a tunable microwave component according to the present invention is a latching phase shifter that remains tuned to a particular frequency after a bias voltage and current are removed. This application would take advantage of the hysteresis of the FE and FM materials, such that a simple decrease or removal of the biasing fields would not return the material to its initial state. To reset the FE and FM materials, the biasing fields could be reversed in polarity. Other applications and devices can also be constructed according to the present invention, as will be appreciated by those of skill in the art.

In sum, because the FE-FM composite can enter a bias mode, a selective combination of FE and FM materials can enable the tunable microwave component to work equally well at two different frequencies since the tunable microwave component will exhibit the same characteristic impedance at each frequency. Furthermore, by selecting appropriate FE and FM materials, components constructed according to the present invention can be relatively small, fast, and perform with relatively low-losses. As a result, a microwave component according to the present invention can be used in a variety of microwave devices, such as phase shifters, frequency filters, directional couplers, power dividers and combiners, impedance matching networks, and the like.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tunable low-loss microwave component, adapted to be in communication with a power source producing an applied voltage and an applied current, comprising:

at least one ferroelectric (FE) material, wherein the at least one FE material changes electric permittivity with the applied voltage, and at least one ferromagnetic (FM) material, wherein the at least one FM material changes magnetic permeability with the applied current, such that the tunable microwave component is tunable to at least a first frequency when the component is a non-bias state in which the power source applies no voltage or current, and tunable to at least a second frequency when the component is in a bias state in which the power source applies voltage and current, and wherein the tunable microwave component has a constant characteristic impedance at the first and second frequencies.

2. The tunable microwave component of claim 1, wherein the tunable microwave component has a constant electrical length at the first and second frequencies.

3. The tunable microwave component of claim 1, wherein the at least one FE material and the at least one FM material are mixed to create a FE/FM composition having both FE and FM material properties.

4. The tunable microwave component of claim 1, wherein the FE material comprises barium strontium titanate.

5. The tunable microwave component of claim 1, further comprising a first conductor in communication with the power source, wherein voltage and current applied via the first conductor causes the tunable microwave component to enter the bias state.

6. The tunable microwave component of claim 1, wherein the tunable microwave component is a microwave transmission line.

7. A microwave transmission line, comprising:

a first conductor;

a second conductor;

a central conductor disposed between the first conductor and the second conductor, and a composite, comprising at least one ferroelectric (FE) material and at least one ferromagnetic (FM) material, wherein the composite substantially surrounds the center conductor, such that the transmission line is tunable to at least a first frequency when the composite is a non-bias state in which the power source applies no voltage or current, and tunable to at least a second frequency when the composite is in a bias state in which the source applies voltage and current, and wherein the microwave transmission line has a constant characteristic impedance at the first and second frequencies.

8. The microwave transmission line of claim 7, wherein the composite comprises a mixture of the at least one FE material and the at least one FM material.

9. The microwave transmission line of claim 7, wherein the composite comprises a block of the at least one FE material and a block of the at least one FM material, and wherein the block of the at least one FE material is located adjacent the center conductor and adjacent to the first conductor, and wherein the block of the at least one FM material is located adjacent the center conductor and adjacent to the second conductor.

10. The microwave transmission line of claim 7, wherein the composite comprises alternating layers of the at least one FE material and the at least one FM material.

11. The microwave transmission line of claim 7, wherein the microwave transmission line has a constant electrical length at the first and second frequencies.

12. The microwave transmission line of claim 7, wherein the at least one FE material comprises barium strontium titanate.

13. A method of creating a tunable, low-loss transmission line having outer conductors and a central conductor, comprising:

providing at least one ferromagnetic (FM) material;

providing at least one ferroelectric (FE) material;

combining the at least one FM material and the at least one FE material to produce a FM/FE composition;

surrounding the center conductor with the FM/FE composition, and sandwiching the FM/FE composite and center conductor in between the outer conductors.

14. The method of claim 13, wherein combining the at least one FM material and the at least one FE material comprises mixing the at least one FM material and the at least one FE material to produce a mixed FM/FE composition.

15. The method of claim 13, wherein combining the at least one FM material and the at least one FE material comprises alternating layers of the at least one FE material and the at least one FM material to produce a layered FM/FE composite.

16. The method of claim 13, wherein combining the at least one FM material and the at least one FE material comprises locating a block of the at least one FE material adjacent the center conductor and adjacent one of the outer conductors, and locating a block of the at least one FM material adjacent the center conductor and adjacent the other one of the outer conductors.

* * * * *